United States Patent [19]

Esbjörnsson

[11] 3,963,146

[45] June 15, 1976

[54] LIQUID-DISPENSING INSTALLATION

[75] Inventor: Stig Uno Ingvar Esbjörnsson, Malmo, Sweden

[73] Assignee: Aktiebolaget Ljungmans Verkstader, Malmo, Sweden

[22] Filed: June 5, 1974

[21] Appl. No.: 476,754

[30] Foreign Application Priority Data

June 5, 1973 Sweden ..... 7307889

[52] U.S. Cl. ..... 222/59; 222/66; 73/200; 137/599

[51] Int. Cl.[2] ..... B67D 5/28

[58] Field of Search ..... 222/20, 14, 55, 72, 222/59, 66; 194/13; 73/200; 137/599

[56] References Cited

UNITED STATES PATENTS

| | | | |
|---|---|---|---|
| 3,040,574 | 6/1962 | Berck | 73/200 |
| 3,053,414 | 9/1962 | Rapisarda | 222/20 |
| 3,550,743 | 12/1970 | Rothschild | 194/13 |

*Primary Examiner*—Robert B. Reeves
*Assistant Examiner*—Joseph J. Rolla
*Attorney, Agent, or Firm*—Beveridge, DeGrandi, Kline & Lunsford

[57] ABSTRACT

A liquid dispensing installation includes an air separator, a volume-meter, a main flow valve in a main conduit, and a bypass valve in a conduit which bypasses the main flow valve. The main flow valve and the bypass valve are normally open during liquid dispensing operations, and both valves are closed in response to reduced pressure in the installation or when a given liquid level is reached in the liquid-receiving container. When the valves are closed in response to reduced pressure, both valves or preferably only the bypass valve will reopen when pressure is restored to a given level.

7 Claims, 8 Drawing Figures

LIQUID-DISPENSING INSTALLATION

This invention relates to an installation for dispensing liquid, such as vehicle fuel, heating oil etc. The installation comprises a liquid container from which liquid is to be supplied to another liquid container, such as the tank of a vehicle, the oil tank of a building etc., in a conduit having means for air separation, a device for metering the liquid volume being dispensed or to be dispensed, and a device for interrupting the dispensing operation.

On dispensing liquids such as vehicle fuels, fuel oils and the like, it is desired to prevent metering of air bubbles in the liquid flowing through the metering device so that the latter will always show the volume of the liquid actually dispensed. Air bubbles may form when the container, from which the liquid is dispensed, runs almost dry. It is also desired to be able, in as simple and inexpensive a manner as possible, to preset the liquid volume to be dispensed. Besides, the installation shall have overflow protection means in order to satisfy the safety requirements stipulated by the authorities.

The object of the present invention is to eliminate the above problems and to satisfy the above desiderata.

According to the invention the device for interrupting the dispensing operation includes first valve means in said supply conduit and second valve means in a conduit by-passing the first valve means, said first and second valve means are connected into a control system adapted to control the valve means and including means which are responsive to the pressure prevailing in the conduit ahead of the first valve means for closing the first and second valve means when the pressure in the supply conduit sinks below a predetermined value, and for opening at least the second valve means when the pressure in the supply conduit rises above the predetermined value after it has been lower than said value.

The pressure-responsive means includes a pressure sensing means which is connected into the supply conduit.

The pressure sensing means is connected into the conduit ahead of the air separating device.

The pressure sensing means is connected into the supply conduit between the metering device and the first valve means.

The pressure sensing means is connected into the by-pass conduit.

The control system includes means for closing the first and second valve means when a given level in the other container is reached.

The control system includes means operable by presetting means for closing the first valve means when a predetermined proportion of liquid of a predetermined volume still remains to be dispensed, and for closing the second valve means in the by-pass conduit after the full preset volume has been dispensed.

Embodiments of the present invention will be more fully described hereinbelow and with reference to the accompanying drawings in which:

FIG. 1 diagrammatically shows some of the component parts of an installation according to the invention, certain parts being shown in the form of a block diagram;

FIG. 2 also diagrammatically shows some of the component parts of an installation according to the invention, certain parts being shown in the form of a wiring diagram;

Figure 1:
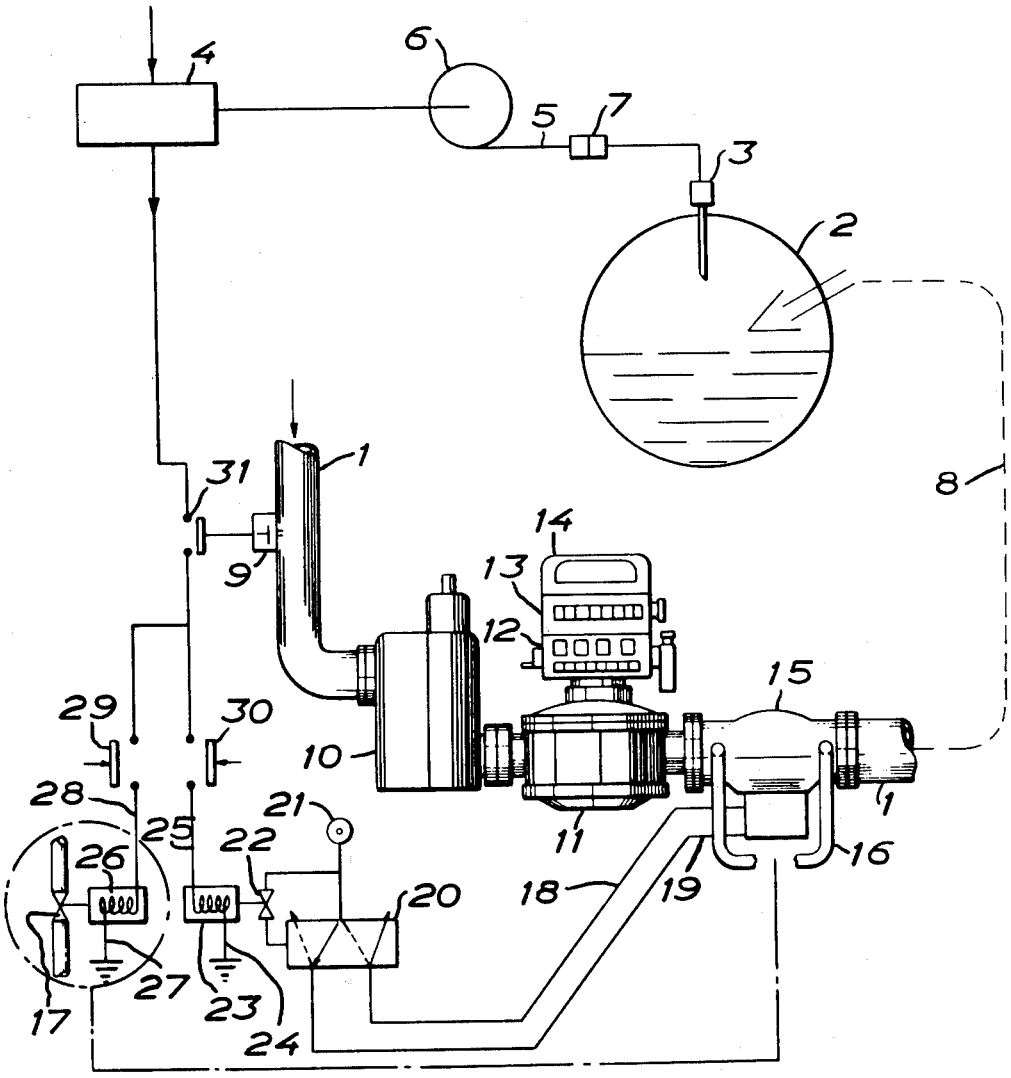
Figure 3:
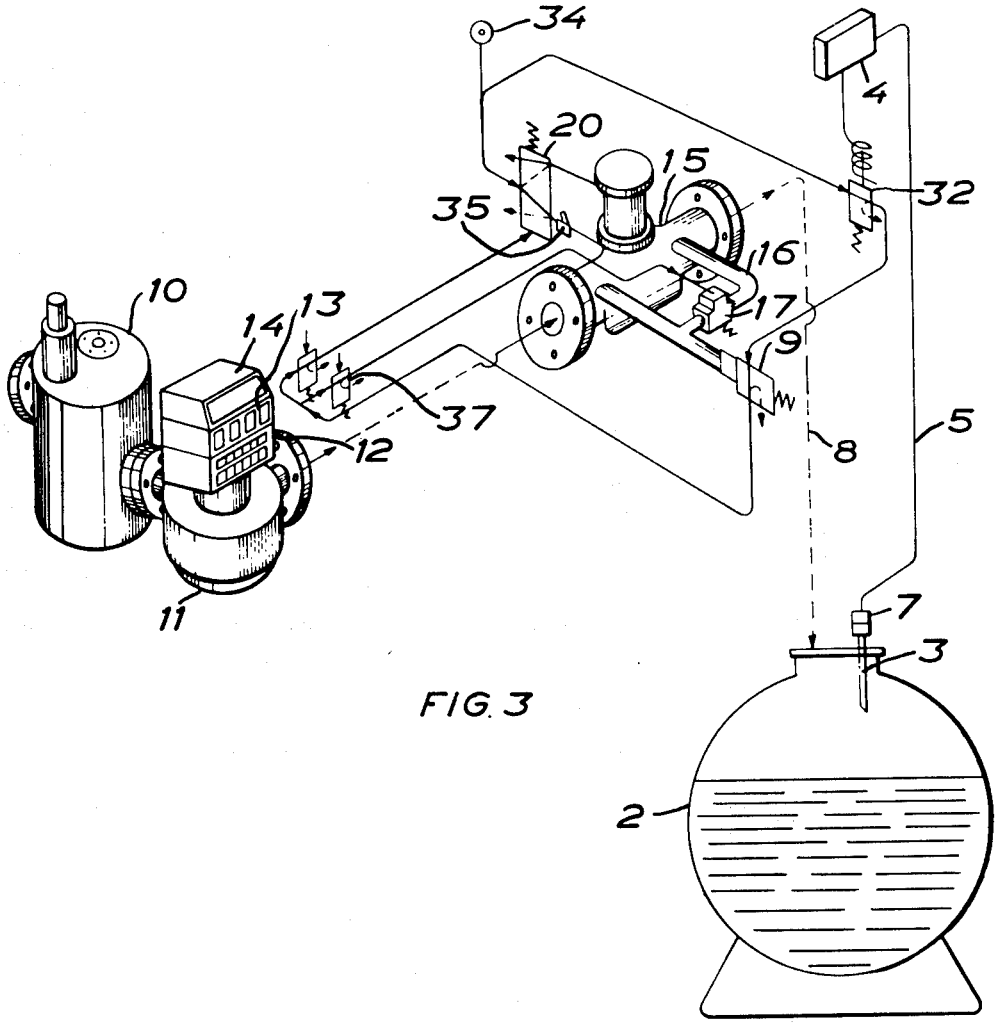
FIG. 3 shows a diagrammatic perspective view of an installation according to the invention, in which certain parts are shown in the form of a block diagram.
Figure 4:
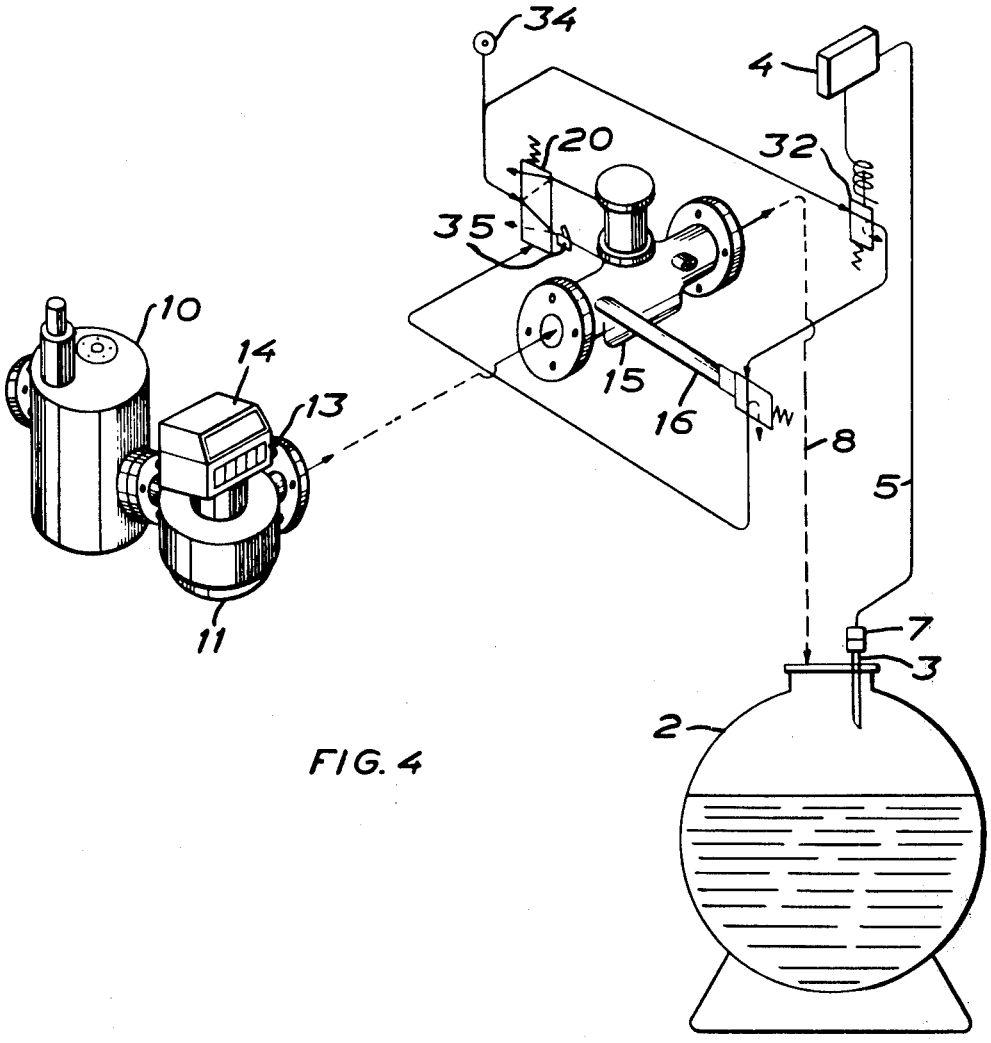
FIG. 4 shows a simplified form of the installation in FIG. 3.
Figure 6:
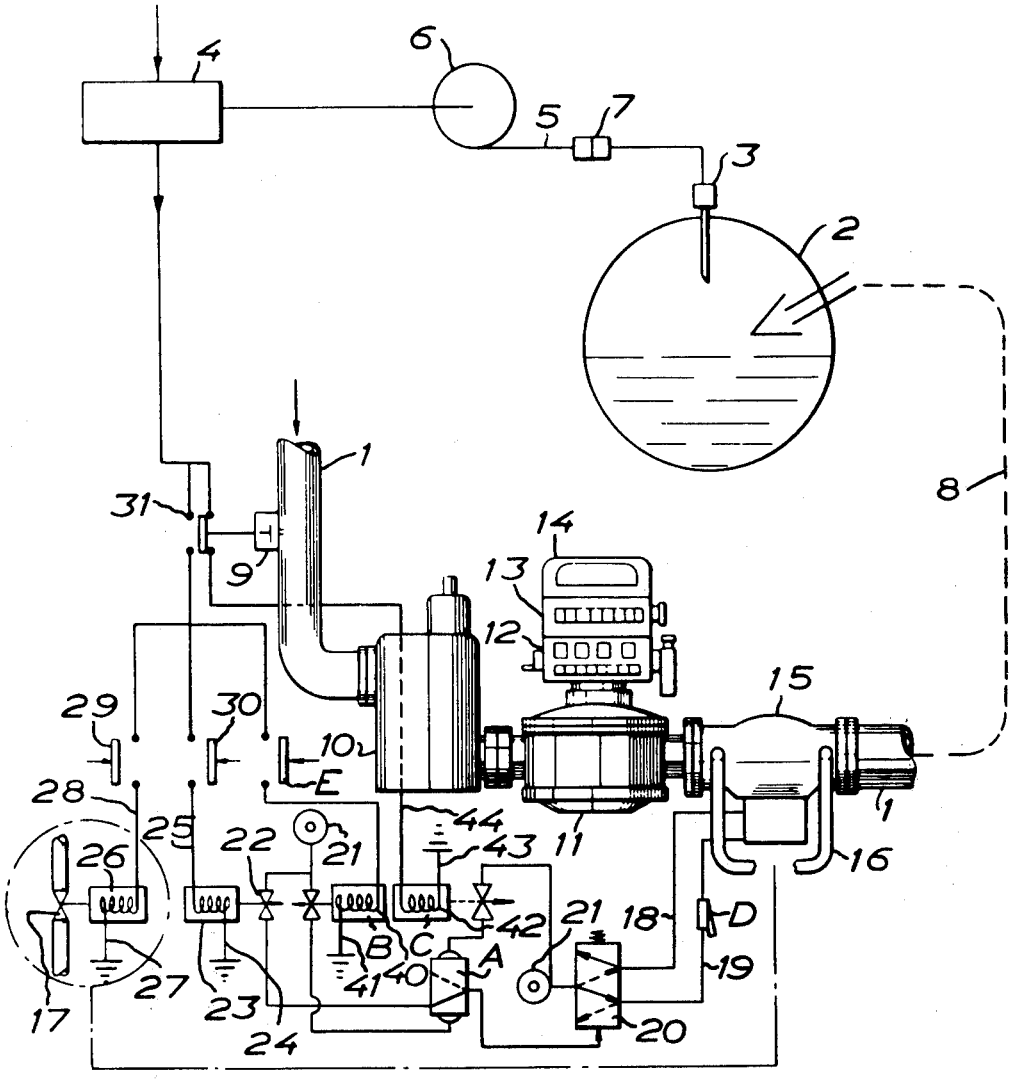
Figure 7:
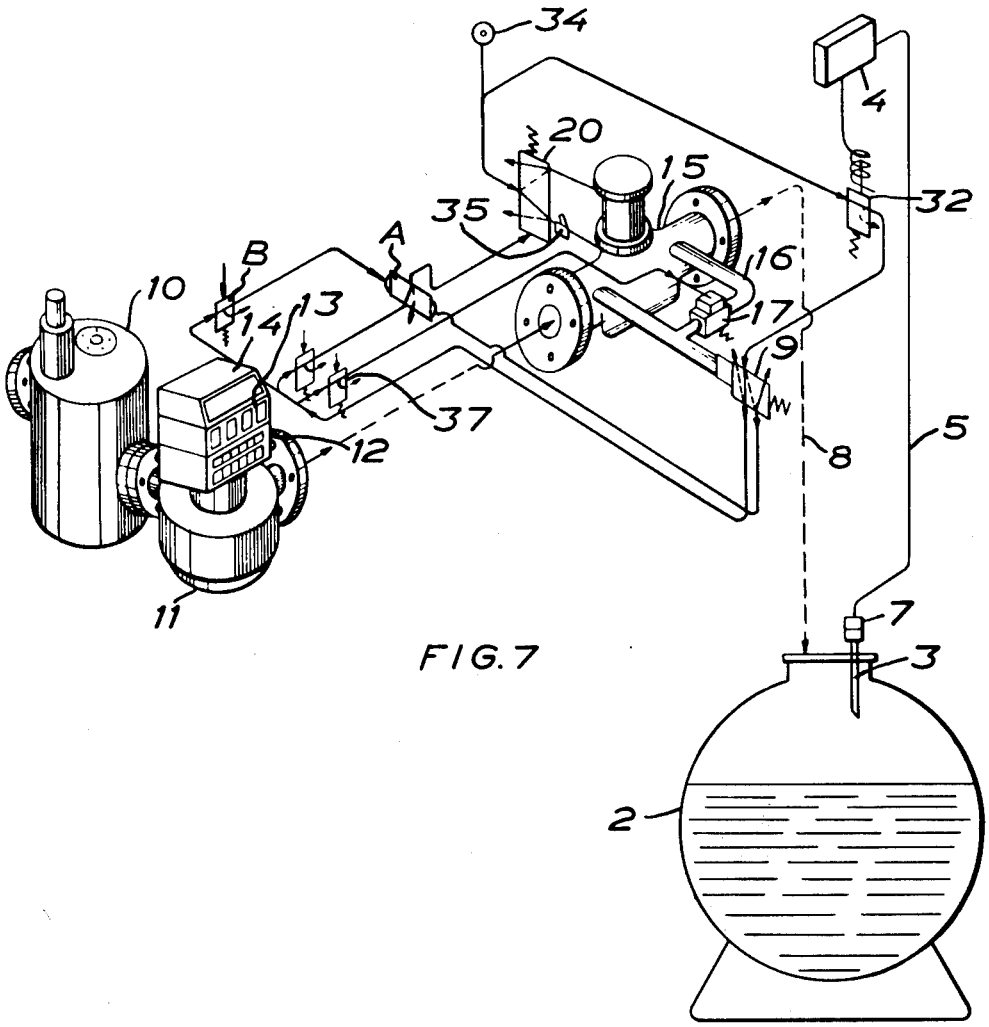
Figure 8:
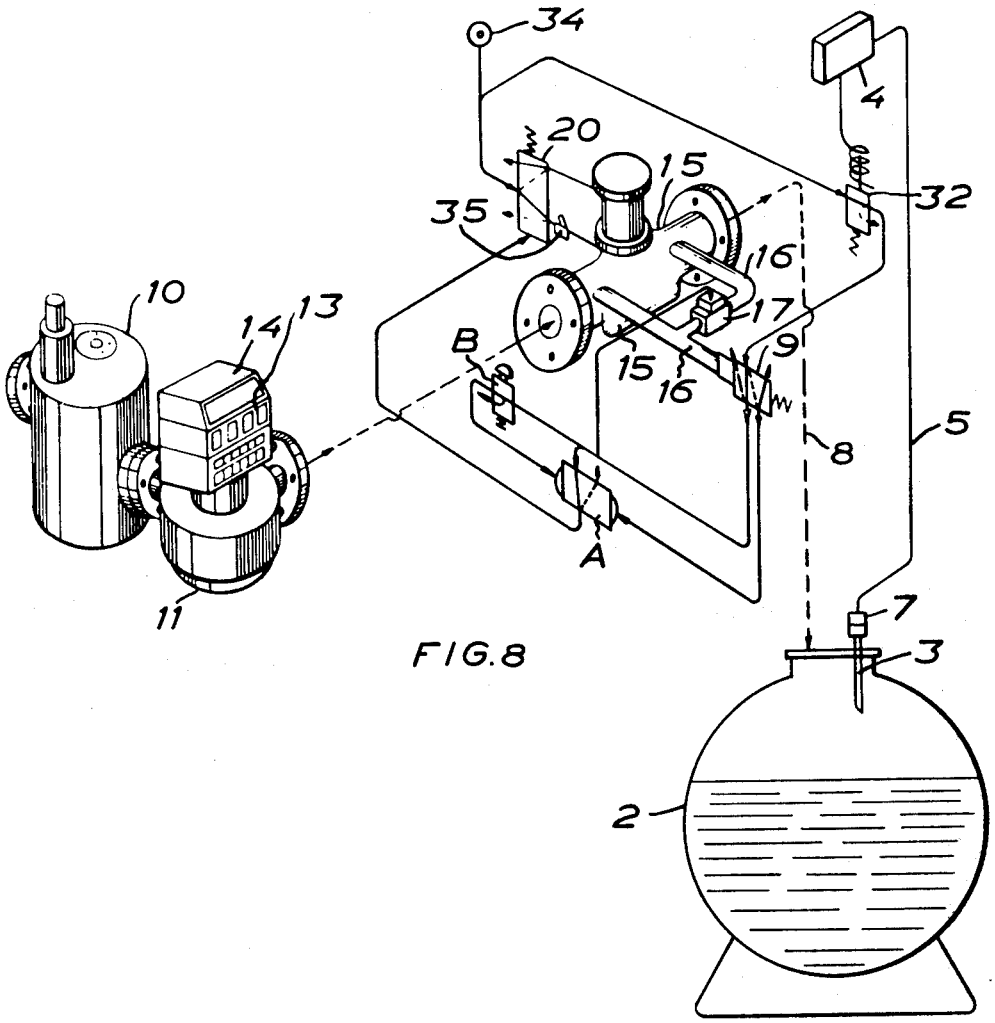

FIG. 6 diagrammatically shows a modification of the installation illustrated in FIG. 1;

FIG. 7 shows a diagrammatic perspective view of a modification of the installation illustrated in FIG. 3;

FIG. 8 shows a perspective view of a modification of the installation illustrated in FIG. 4.

The installation according to the present invention, which is shown in FIG. 1, comprises a supply conduit 1 which extends from a container (not shown) and includes a pump (not shown). The container may be the tank of a road tanker or like vehicle and be intended for fuel oil which is to be filled into a container 2 placed in a building. The container 2 has an overflow feeler 3 which is connected to an electronic amplifier 4 on the road tanker via a cable 5 which may be arranged to be wound onto a cable reel 6. The cable 5 is connected to the feeler 3 via conventional connector means 7. The container 2 is connected to the outlet end of the conduit 1 via a hose 8 (only diagrammatically shown).

Connected into the conduit 1 is a pressure sensing means 9, an air separator 10 of conventional type with a float that closes the outgoing air channel when the liquid level in the air separator exceeds a predetermined value, and with a float that closes the outlet of the air separator 10 when the liquid level therein is below a predetermined level. This outlet float may be dispensed with. Connected to the air separator 10 is a throughflow meter 11 of a per se conventional type which may be provided with a presetting device 12, a totalizing meter or register 13 and a printing register 14. Connected to the outlet of the throughflow meter 11 is a shut-off valve 15 which is an air cylinder-controlled, liquid pressure-relieved shut-off valve. Said shut-off valve 15 has a by-pass conduit 16 with a usually open valve 17 that is closed for completion of a presetting dispensing operation, when the shut-off valve 15 is already closed, whereby the dispensing of a preset liquid volume will be very exact since the throughflow volume per unit of time will be considerably less in the by-pass conduit 16 than in the valve 15 proper.

The shut-off valve 15 is opened and closed by means of an air cylinder which has one end connected to a conduit 18 and the other end connected to a conduit 19. The conduits 18 and 19 lead to a compressed air valve 20, which is connected to a source of compressed air 21 and which is spring-loaded to feed compressed air to the conduit 19 in its position of rest, thereby closing the valve 15. The valve 20 furthermore is compressed air-operated via a control valve 22, which has one end connected to the source of compressed air 21 and the other end connected to the control inlet of the valve 20. Furthermore, the valve 22 is actuated by means of a solenoid 23, which is connected to earth via a cable 24 and to an electric power source via a cable 25.

The valve 17 is also actuated by means of a solenoid 26 which is connected to earth via a cable 27 and to an electric power source via a cable 28. Connected into the cable 28 is a switch 29 and into the cable 25 a switch 30. After the switches 29 and 30, the cables 25 and 28 are interconnected and lead to a switch 31 which is actuated by the pressure sensing means 9 in such a way that the switch 31 is closed as long as a given predetermined pressure, say 0.9 kg/cm², is maintained in the conduit 1. The switch 31 is further connected to the electronic amplifier 4, which in turn is connected to the feeler 3 and an electric power source, of for instance 24V (not shown).

The installation described in the foregoing operates as follows. For dispensing say 1000 liters of oil, the presetting device 12 is set at 1000, whereby the switches 29, 30 are closed. When the pump is started and pumps liquid to the air separator 10 through the throughflow meter 11 and to the shut-off valve 15, the pressure in the conduit 1 will rise and when the pressure is exceeded, at which the pressure sensing means 9 is actuated, the switch 31 is closed and a signal is supplied from the amplifier 4 to the solenoids 23 and 26, whereby the valves 17 and 22 are actuated and compressed air is supplied to the valve 20 which is actuated so as to feed compressed air to the conduit 18, whereby the shut-off valve 15 and the valve 17 are opened. This state is maintained provided that the feeler 3 in the container 2 does not react. If the liquid level in the container 2 should exceed the level predetermined by means of the feeler 3, the signal to the solenoids 23 and 26 is interrupted whereby the shut-off valve 15 and the valve 17 will be closed. If the pressure in conduit 1 should sink due to the container from which the liquid is pumped being emptied, the switch 31 will be opened and interrupt the signal to the solenoids 23 and 26 so that the valves 15 and 17 are closed. After the greater proportion of the preset volume has been dispensed, the presetting device 12 will open the switch 30, whereby the shut-off valve 15 is closed. The last proportion of the preset volume is dispensed via the by-pass conduit 16 through the still open valve 17, whereupon the switch 29 is opened and the valve 17 is closed.

The described installation not only prevents metering of air but also permits exact preset dispensing and further has overflow protection means.

Many components of the described installation are of the electric type, which may be disadvantageous in installations for the handling of inflammable liquids.

Figure 2:
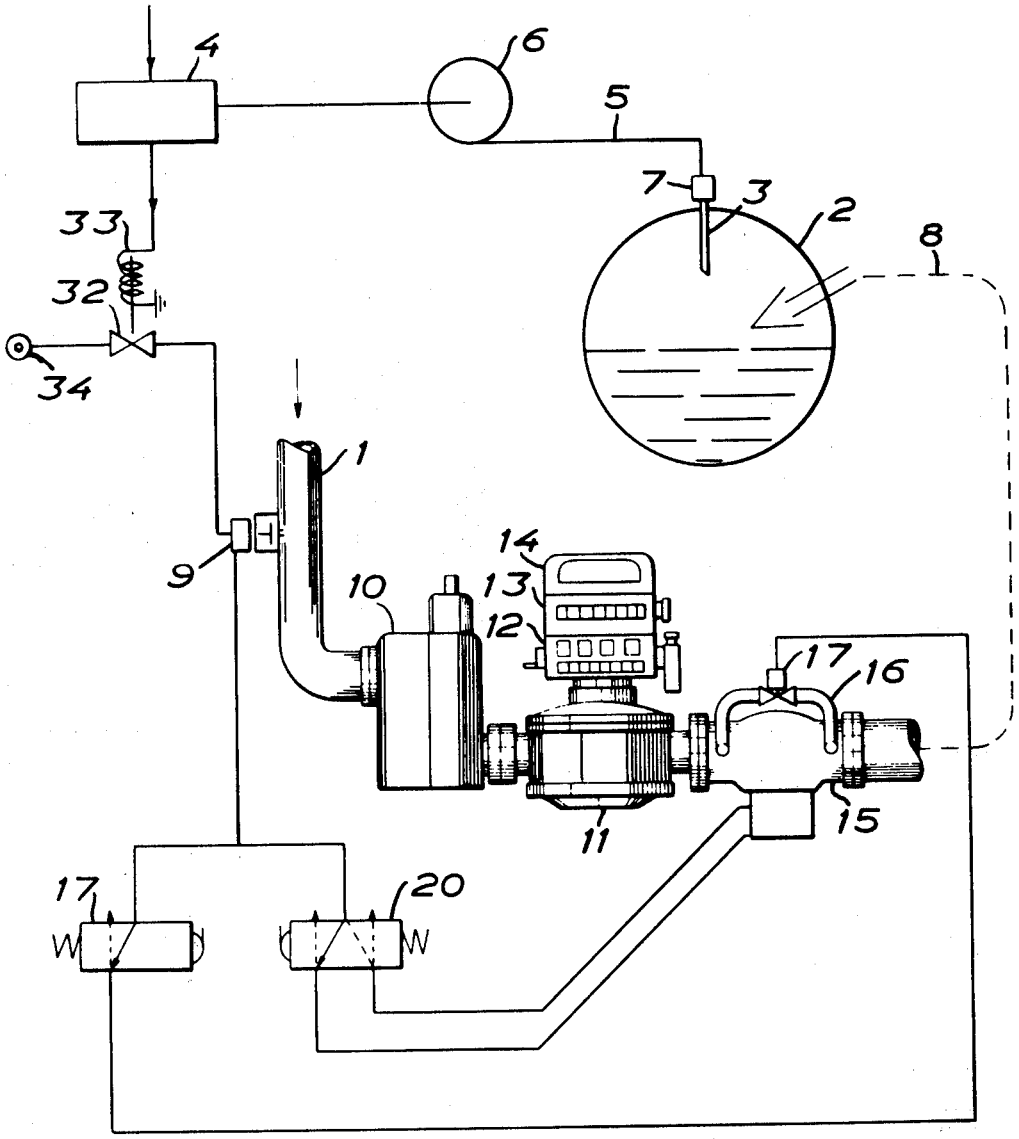

In the embodiment illustrated in FIG. 2, the valve 20 is of the pneumatical type as is the valve 17. In this case the valve 17 controls an air cylinder. Further, the pressure sensing means 9 is of the pneumatical type and compressed air is supplied to these valves via a solenoid-operated valve 32, the solenoid 33 of which is connected to the amplifier 4. As long as the valve 32 is open, compressed air will be supplied from a source of compressed air 34 to the pressure sensing means 9 and the valves 17 and 20. Otherwise, the installation fundamentally is the same as that shown in FIG. 1. It should be observed that the valves 17 and 20 are actuated mecahnically by means of the presetting device 12 and that the valve 20 is a four-way valve, while the valve 17 is a three-way valve. The pneumatical pressure sensing means is of a type such as to connect the compressed air conduit from the valve 32 with the compressed air conduit to the valves 17 and 20. In this embodiment the air cylinders are spring-loaded towards the closing position.

FIG. 3 shows a further modification of the installations described above. The main difference of this modified installation is that the pressure sensing means 9 is connected into the by-pass conduit 16. Moreover, a flow regulator 35 is connected into the conduit to be deaerated when the valve 15 is to be closed. Further, a three-way type valve 36 is connected into the compressed air conduit leading from the pressure-sensing means 9 to the valve 20. This valve 36 is actuated by means of the presetting device 12 for actuation of the valve 20. A valve 37 for actuation of the valve 17 is connected into the conduit leading from the pressure sensing means 9 to the valve 17. This valve 37, which is of the three-way type, is actuated by means of the presetting device 12. in this case, the valve 17 is a two-way liquid valve which is actuated by means of compressed air. Further, in this modified installation, the level feeler 3 is of the thermistor type, the pressure sensing means 9 is a pressure control means including a three-way compressed air valve, the shut-off valve 15 is an air cylinder-controlled, liquid pressure-relieved shut-off valve, the valve 20 is a four-way auxiliary valve for compressed air, and the valve 32 is a three-way solenoid valve for compressed air.

In the installation shown in FIG. 4 the presetting device has been dispensed with, while the overflow protection means and the means preventing air metering are connected.

Figure 5:
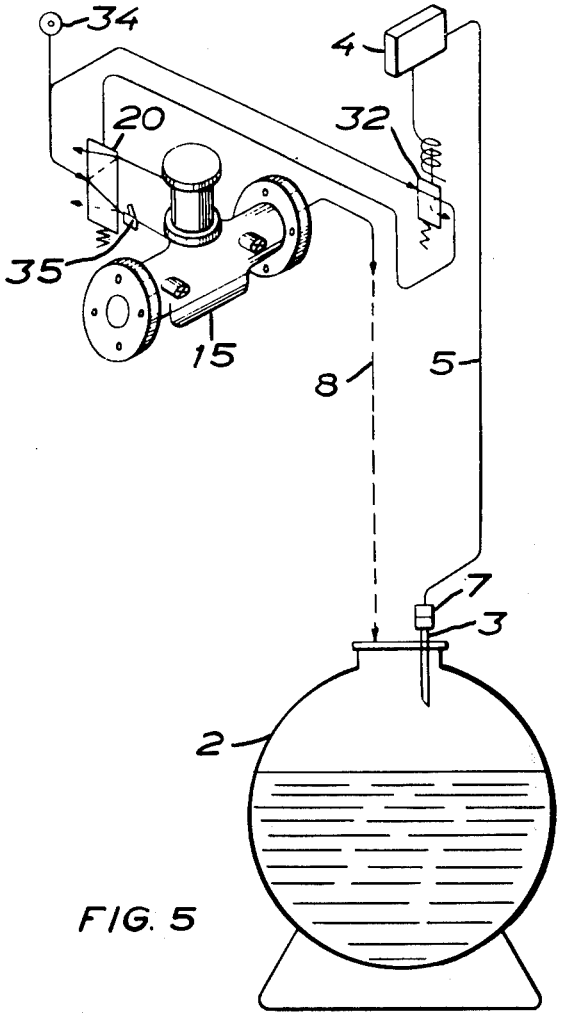
FIG. 5 shows another simplified form of the installation in FIG. 3.

The installation shown in FIG. 5 includes only the electronic overflow protection means, but the shut-off valve 15 is prepared for modification either into means preventing air metering or into presetting means only, or both.

The installations according to the present invention as illustrated in FIGS. 1, 3 and 4 can be modified in the manner apparent from FIGS. 6, 7 and 8, respectively, so that the following functions are obtained, namely positive closure of the shut-off valve 15 and automatic opening of the valve 17 only after a release of the pressure sensing means 9. It is necessary to intervene manually in order that the valve 15 shall open after a release of the pressure sensing means.

To this end, the installation illustrated in FIG. 1 has been modified in the manner apparent from FIG. 6. A flow regulator D is connected into the conduit 19. Moreover, the other end of the control valve 22 is connected to the control input of the valve 20 via a double, pneumatically controlled three-way valve A, one control input of which is connected to the compressed air source 21 via a control valve B which is a three-way type solenoid valve, while the other control input of the three-way valve A is connected to the compressed air source 21 via a further control valve C which is also a three-way type solenoid valve. The control valve B is actuated by means of a solenoid 40 one end of which is connected to earth via a line 41 and the other end of which is connected to one contact of the switch 29 via a switch E. The valve C is actuated by means of a solenoid 42 one end of which is connected to earth via a line 43 and the other end of which is connected to the amplifier 4 via a line 44 and the switch 31 which in this case is modified for opening the line 44 when the pressure in the supply conduit 1 is below the predetermined value.

The modification described above operates as follows. When a dispensing operation has been initiated and the pressure in the conduit 1 exceeds the predetermined value, the switch 31 is actuated to the position opposite to the position shown, as are the switches 29 and 30 when the presetting device 12 is set in the manner indicated above. In this condition the control valve C is in such a position that connection is established with the compressed air source 21 and the valve is actuated to the position in which the valve 20 opens the shut-off valve 15.

If the pressure in the supply conduit 1 should be below the predetermined value the pressure sensing means 9 reacts and thereby set into the right-hand position illustrated in FIG. 6. When the switch 31 is actuated to this position energization of the solenoids 23 and 26 is interrupted and energization of the solenoid 42 is initiated. As a result, the valve A will be actuated and in turn bring about actuation of the valve 20 for connection of the compressed air source 21 with the conduit 19 and for positive closure of the valve 15. If the pressure in the supply conduit 1 again exceeds the predetermined value the switch 31 is again actuated to the position opposite to that illustrated in FIG. 1 so that the solenoids 23, 26 are again energized while energization of the solenoid 42 is interrupted. As a result, the valve 17 will be opened and allow flow of liquid through the by-pass conduit 16. Although the solenoid 23 is energized the valve A will prevent automatic opening of the valve 15 since an actuation of the valve A requires energization of the solenoid 40 in the valve B. Energization of the solenoid 40 is only obtained after the switch E has been closed.

In this way a strong liquid flow through the valve 15 is prevented and so is an ensuing release of the pressure sensing means 9. Of course, the switch E may, if desired, be time-delayed instead of manually actuable.

As will appear from FIG. 7 the installation therein illustrated is substantially identical with the installation of FIG. 3, apart from being modified along the same lines as the installation shown in FIG. 1. It should be observed, however, that in this modification a four-way valve has been substituted for the valve 9, while the valve A is identical with the valve A in FIG. 6, and the valve B in this figure is a three-way valve of the same type as the valve 37. As in the installation according to FIGS. 2 and 3, all valves are compressed air valves. The pressure sensing valve 9 is connected to one control input of the valve A, while the other control input is connected to the output of the valve B, and the input of the valve B is connected to the compressed air source via the pressure sensing means 9 and the valve 32. The input of the valve A is connected to the output of the valve 13 and the output of the valve A is connected to the control input of the valve 20. After the pressure sensing means 9 has been released once, the valve A is actuated in such a way that the valve 20 is not actuated for opening of the valve 15 until the valve B has been manually actuated.

The installation shown in FIG. 8 principally is identical with the installation of FIG. 4 but is modified so that the same functions are obtained as in the installations according to FIGS. 6 and 7. It should be observed, however, that the by-pass conduit 16 in this modification contains valves 17 which are connected to the compressed air source 34 via the pressure sensing means 9 and the valve 32. Moreover, the compressed air source 34 is connected to the input of the valve B and the input of the valve A. The valves A and B are identical with the valves A and B in FIG. 7. The output of the valve B is connected to one control input of the valve A, and the other control input of the valve A is connected to that output of the pressure sensing means 9 which after release of said means conducts compressed air. The output of the valve A is connected to the control input of the valve 20. It should also be observed that the valve B in the installation according to FIG. 8 is push-button operated; it can, of course, be operated in many other different ways.

What I claim and desire to secure by Letters Patent is:

1. An installation for dispensing liquid, such as vehicle fuel, heating oil etc, from a liquid-delivering container to a liquid-receiving container, such as the tank of a vehicle, the oil tank of a building etc, conduit means for communication between said containers including means for air separation, means for metering the liquid volume dispensed, means for interrupting the dispensing operation, having first valve means in said conduit means and second valve means in a conduit by-passing said first valve means, control means responsive to the pressure in the conduit means upstream of said first valve means for closing said first and second valve means when said pressure sinks below a predetermined value, and for first opening said second valve means and not said first valve means when said pressure rises above said predetermined value after said pressure has been lower than said value.

2. An installation as claimed in claim 1, wherein said control means includes a pressure sensing means which is in communication with said conduit means.

3. An installation as claimed in claim 2, wherein said pressure sensing means is in communication with said conduit upstream of said air separating means.

4. An installation as claimed in claim 2, wherein said pressure sensing means is in communication with said conduit means between said metering means and said first valve means.

5. An installation as claimed in claim 4, wherein said pressure sensing means is positioned in said by-pass conduit.

6. An installation as claimed in claim 1, wherein said control means includes means for closing the first and second valve means when a given level in said liquid-receiving container is reached.

7. An installation as claimed in claim 1, wherein said control means includes means operable by presetting means for closing said first valve means when a predetermined proportion of liquid of a preset volume still remains to be dispensed and for closing said second valve means in said by-pass conduit after the full present volume has been dispensed.

* * * * *